US005760329A

United States Patent [19]

Baum et al.

[11] Patent Number: 5,760,329

[45] Date of Patent: Jun. 2, 1998

[54] AMMUNITION ROUND FOR GUNS

[75] Inventors: Hans-Georg Baum, Nassau; Andreas Michael Christen, Fachbach, both of Germany

[73] Assignee: Metallwerk Elisenhutte GmbH, Nassau, Germany

[21] Appl. No.: 863,553

[22] Filed: May 27, 1997

[30] Foreign Application Priority Data

Feb. 19, 1997 [EP] European Pat. Off. ..... 97102617

[51] Int. Cl.[6] ..... F42B 12/34; F42B 12/40

[52] U.S. Cl. ..... 102/439; 102/510; 102/513; 102/517

[58] Field of Search ..... 102/439, 507–510, 102/513, 514–517, 519, 501

[56] References Cited

U.S. PATENT DOCUMENTS

| | | | |
|---|---|---|---|
| 581,946 | 5/1897 | Semple | 102/513 |
| 843,017 | 2/1907 | Hoxie | 102/510 |
| 1,094,402 | 4/1914 | Keen | 102/513 |
| 2,319,248 | 5/1943 | Meek | 102/513 |
| 3,013,495 | 12/1961 | Stevenson et al. | 102/513 |
| 3,710,723 | 1/1973 | Muller et al. | 102/513 |
| 3,972,291 | 8/1976 | Braun, Jr. et al. | 102/513 |
| 4,528,911 | 7/1985 | DePhillipo et al. | 102/513 |

FOREIGN PATENT DOCUMENTS

| | | | |
|---|---|---|---|
| 1131561 | 6/1962 | Germany | 102/513 |
| 924954 | 5/1963 | United Kingdom | 102/513 |

*Primary Examiner*—Harold J. Tudor
*Attorney, Agent, or Firm*—Merchant, Gould, Smith, Edell, Welter & Schmidt, P.A.

[57] ABSTRACT

An ammunition round for guns has a cartridge case provided with a detonator cap at one end, a bullet inserted in the other open end and an explosive charge between them. The base of the bullet has a recess in which there is a pyrotechnic insert generating an illuminated trace when the bullet is fired. The bullet may be an expanding bullet. The round provides a bullet with an integral trace device.

7 Claims, 1 Drawing Sheet

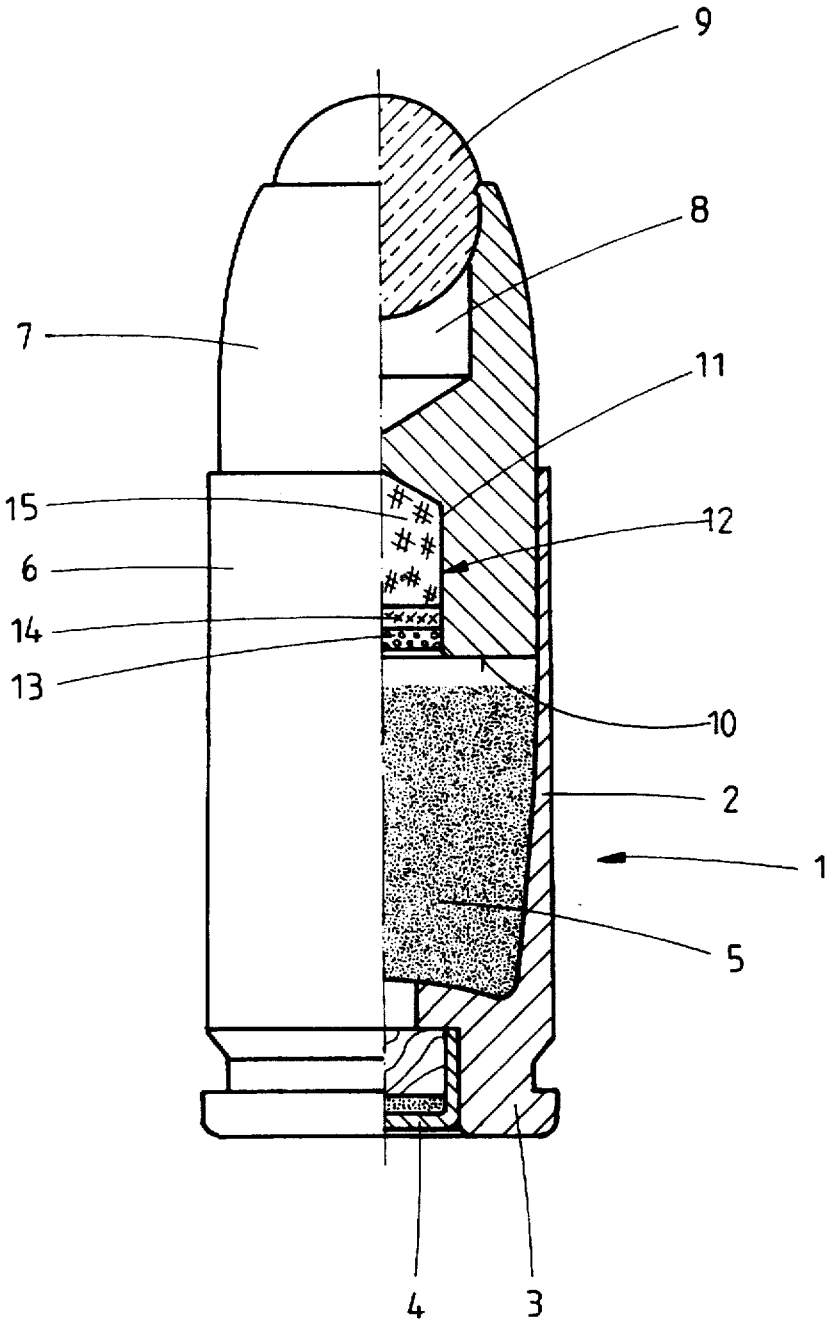
9
8
7
11
15
12
6
14
13
10
2
1
5
4
3

AMMUNITION ROUND FOR GUNS

The invention relates to an ammunition round for guns comprising a cartridge case with a detonator cap at one end, a bullet inserted in the other open end and an explosive charge between the detonator cap and the bullet.

This ammunition round is suitable both for hand-held pistols and also for hand guns such as rifles or machine pistols.

Ammunition of this kind is known. Tracer rounds are also known, but these have a different calibre and a different construction.

It is the aim of the invention to provide an ammunition round for hand guns having a bullet and a tracer device.

According to the present invention, ammunition round for a gun comprises a cartridge case having opposing first and second ends, a detonator cap closing said first end of said cartridge case, a bullet accommodated in said second open end of said cartridge case, said bullet having an inner end in said cartridge case, and an outer end outside said cartridge case, and an explosive charge contained in said cartridge case between said detonator cap and said inner end of said bullet, in which said lower end of said bullet is provided with a recess, and a pyrotechnic insert in said recess which generates an illuminated trace when said bullet is fired by detonation of said explosive charge.

The round according to the invention comprises an already-known cartridge case with a detonator cap and an explosive charge and a special bullet which contains in its lower-end an insert providing a tracer device.

The pyrotechnic insert preferably comprises an ignition body adjacent the explosive charge, an intermediate body and an illuminating body. The illuminating body includes tracer chemicals, which may for example be "green" or "red".

In the round according to the invention the weight of the bullet is increased by the insert. This provides better efficiency of the charge and improves the ignition behaviour of the pyrotechnic insert.

The invention provides a round for hand guns of all kinds with a tracer insert. It is particularly suitable for a round having an expanding bullet. However, the invention is also suitable for bullets of which the body is made homogeneously of metal.

An embodiment by way of example of an ammunition round according to the invention is shown in the drawing to an enlarged scale and partially in longitudinal section.

The ammunition round 1 illustrated in the drawing is for a hand gun (not shown). The round 1 comprises a substantially cylindrical cartridge case 2 with a first end or base 3 closed by a detonator cap 4. The cartridge case 2 also contains an explosive charge 5 which is ignited by the cap 4 when the latter is struck by the firing pin of the gun.

A 9 mm calibre bullet 7 is inserted in the second open end 6 of the cartridge case 2. The bullet 7 has an inner end 10 in the cartridge case 2, and an outer end outside the case 2.

The bullet 7 is an expanding or dum-dum bullet, with a blind hole 8 extending in from its outer end and containing a ball 9 made of elastically yielding material. The bullet 7 has a part-spherical widening in the outer end, with an inner diameter smaller than a diameter of the ball 9 in at least one point. As shown in the drawing, the part-spherical widening may have an inwardly oriented lip portion. The ball 9 is inserted with some deformation and when the bullet hits a target the ball is driven back into the hole 8 and spreads the bullet out in order to achieve a better wound effect which is associated with greater vascular destruction.

The bullet 7 has a further blind hole 11 extending in from its lower end 10. This provides a recess for a pyrotechnic insert 12. When the round is fired the bullet 7 leaves an illuminated trace behind it, due to the insert 12 functioning as a tracer device.

The pyrotechnic insert 12 is made in three layers, comprising an outer ignition body 13 adjacent the charge 5, an intermediate body 14 and an illuminating body 15.

When the explosive charge 5 is ignited and thereby the bullet is driven out of the cartridge case 2 the ignition layer 13 is ignited and through the intermediate layer 14 it activates the illuminating body 15 in order to leave a coloured trace during the flight of the bullet 7.

Two examples are given for the composition of pyrotechnic inserts for producing a green or a red trace. It will be noted from the examples that the intermediate body 14 is composed of equal parts of the compositions forming the ignition and illuminating bodies 13, 15.

| | | | |
|---|---|---|---|
| Example 1 | | | |
| A | Green Trace | | |
| 1. | Green Ignition Body AG1 about 10 mg | Barium nitrate | 29% |
| | | Strontium peroxide | 10% |
| | | Barium peroxide | 40% |
| | | Al Mg powder | 15% |
| | | Plastics resin | 6% |
| 2. | Green Illuminating Body LG1 about 50 mg | Barium nitrate | 33.5% |
| | | Barium peroxide | 45% |
| | | Mg Powder 4 | 7.5% |
| | | Mg Powder 5 | 7.5% |
| | | Plastics resin | 6% |
| 3. | Green Intermediate Body ZG1 about 10 mg | Ignition body AG1 | 50% |
| | | Illuminating body LG1 | 50% |
| Example 2 | | | |
| B | Red Trace | | |
| 4. | Red Ignition Body AR1 about 10 mg | Strontium nitrate | 4% |
| | | Strontium peroxide | 65% |
| | | Barium peroxide | 10% |
| | | Al Mg powder | 15% |
| | | Plastics resin | 6% |
| 5. | Red Illuminating Body LR1 about 50 mg | Strontium nitrate | 27% |
| | | Strontium peroxide | 45% |
| | | Barium peroxide | 7% |
| | | Mg powder 4 | 18% |
| | | Plastics resin | 8% |
| 6. | Red Intermediate Body ZR1 about 10 mg | Ignition Body AR1 | 50% |
| | | Illuminating Body LR1 | 50% |

What is claimed is:

1. An ammunition round for a gun comprising:

a cartridge case having opposing first and second ends;

a detonator cap closing said first end of said cartridge case;

an expanding bullet accommodated in said second end of said cartridge case, said expanding bullet having an inner end in said cartridge case and an outer end outside said cartridge case, said expanding bullet comprising a ball of an elastically yielding material, inserted with some deformation in a part-spherical widening in the outer end of said expanding bullet, where the part-spherical widening has a diameter smaller than a diameter of the ball in at least one point;

an explosive charge contained in said cartridge case between said detonator cap and said inner end of said expanding bullet, in which said lower end of said expanding bullet is provided with a recess; and a pyrotechnic insert in said recess which generates an illuminated trace when said expanding bullet is fired by detonation of said explosive charge.

2. The ammunition round according to claim 1, wherein said pyrotechnic insert comprises an ignition body adjacent said explosive charge, an intermediate body and an illuminating body.

3. The ammunition round according to claim 2, wherein said illuminating body comprises tracer chemicals.

4. The ammunition round according to claim 2, wherein:

the ignition body is formed from ignition material comprising barium nitrate, strontium peroxide, barium peroxide, aluminum magnesium powder and plastics resin;

the illuminating body is formed from illuminating material comprising barium nitrate, barium peroxide, magnesium powder 4, magnesium powder 5 and plastics resin; and the intermediate body is formed from a mixture of said ignition material and said illuminating material.

5. The ammunition round according to claim 2, wherein:

the ignition body is formed from ignition material comprising strontium nitrate, strontium peroxide, barium peroxide, aluminum magnesium powder and plastics resin;

the illuminating body is formed from illuminating material comprising strontium nitrate, strontium peroxide, barium peroxide, magnesium powder 4 and plastics resin; and the intermediate body is formed from a mixtare of said ignition material and said illuminating material.

6. The ammunition round according to claim 1, wherein said expanding bullet is 9 mm caliber.

7. The ammunition round according to claim 1, wherein said part-spherical widening comprises an inwardly oriented lip portion for engaging the ball.

* * * * *